US006152814A

United States Patent [19]

Amarosa, Sr. et al.

[11] Patent Number: 6,152,814

[45] Date of Patent: Nov. 28, 2000

[54] EXPANDABLE ABRASIVE BELT FOR USE WITH INFLATABLE TOOL

[75] Inventors: Robert P. Amarosa, Sr., Durham; Peter J. Amarosa, Greenland, both of N.H.

[73] Assignee: RP Abrasives & Machine Co. Inc., Rochester, N.H.

[21] Appl. No.: 09/398,159

[22] Filed: Sep. 16, 1999

[51] Int. Cl.[7] ..... B24D 11/00

[52] U.S. Cl. ..... 451/526; 451/504; 451/505; 451/507

[58] Field of Search ..... 451/504, 505, 451/507

[56] References Cited

U.S. PATENT DOCUMENTS

| | | | |
|---|---|---|---|
| 1,045,201 | 11/1912 | Shoop . | |
| 1,948,643 | 2/1934 | Bertrand . | |
| 2,225,073 | 12/1940 | Miller . | |
| 2,323,962 | 7/1943 | Ames . | |
| 2,483,278 | 9/1949 | Hamilton | 451/505 |
| 2,601,048 | 6/1952 | Monger . | |
| 2,605,594 | 8/1952 | Macdonell . | |
| 2,774,200 | 12/1956 | Block | 451/507 |
| 3,166,876 | 1/1965 | Manchester | 451/507 |
| 3,178,863 | 4/1965 | Mikiya . | |
| 3,203,073 | 8/1965 | Stein . | |
| 3,211,449 | 10/1965 | Lewis et al. . | |
| 3,232,011 | 2/1966 | Pineau . | |
| 3,253,323 | 5/1966 | Saueressig . | |
| 3,319,686 | 5/1967 | Prevette . | |
| 3,362,113 | 1/1968 | Feather . | |
| 3,653,857 | 4/1972 | Field . | |
| 3,747,286 | 7/1973 | Haigh . | |
| 3,848,374 | 11/1974 | Hasegawa . | |
| 4,054,425 | 10/1977 | Sherman . | |
| 4,897,968 | 2/1990 | Hutt . | |
| 5,222,333 | 6/1993 | Watanabe et al. . | |
| 5,310,455 | 5/1994 | Pasch et al. . | |
| 5,351,447 | 10/1994 | Grauert . | |
| 5,516,400 | 5/1996 | Pasch et al. . | |
| 5,672,096 | 9/1997 | Amarosa et al. | 451/504 |
| 5,931,729 | 8/1999 | Penttila et al. . | |
| 6,001,202 | 12/1999 | Penttila et al. . | |
| 6,033,449 | 3/2000 | Cooper et al. . | |

OTHER PUBLICATIONS

Ekstrom, Carlson & Co., Pneumatic Drum Sanders, Catalog No. PS–8, Rockford, IL.

Nu–Matic Grinders, Inc., Price/Parts List, Nov. 1, 1994, 4 Page Brochure, Cleveland, OH.

*Primary Examiner*—Stephen F. Gerrity
*Assistant Examiner*—Shantese McDonald
*Attorney, Agent, or Firm*—Bourque & Associates, P.A.

[57] ABSTRACT

An expandable abrasive sleeve is used on an inflatable tool for abrading or finishing a surface of a workpiece. The inflatable tool includes an inflatable bladder clamped at first and second ends of a core having an elastomeric outer core portion. The inflatable bladder is inflated by a pressurized medium and forms a pocket or chamber around the elastomeric outer core portion. The expandable abrasive sleeve is disposed around the inflatable bladder and expands from one end to the other end when inflated. The expandable abrasive sleeve includes an elastomeric backing and abrasive strips adhered to the elastomeric backing in an overlapping arrangement. In one embodiment, the elastomeric backing includes stiffeners embedded therein and extending generally longitudinally.

16 Claims, 9 Drawing Sheets

EXPANDABLE ABRASIVE BELT FOR USE WITH INFLATABLE TOOL

FIELD OF THE INVENTION

The present invention relates to abrasive tools and in particular, to an expandable abrasive tool and an expandable abrasive belt or sleeve for use therewith.

BACKGROUND OF THE INVENTION

Inflatable tools have been used for abrading or finishing workpiece surfaces, such as by sanding, grinding, deburring, buffing, and polishing. Inflatable tools typically provide a flexible abrading surface that is preferred over rigid abrading surfaces. For example, rigid abrading surfaces often cause vibrating or chattering of the tool and workpiece, thereby causing damage to the tool and the workpiece, particularly when the workpiece surface is uneven. An inflatable tool provides a flexible abrading surface that yields to the workpiece surface to avoid chattering and damaging the workpiece surface.

Prior art inflatable tools, however, have not sufficiently met the needs of different types of abrading and machining and difference sizes and shapes of workpieces. One problem with many of the prior art inflatable tools is that they are overly complex and are limited in size. Such devices are also expensive to manufacture, difficult to use, and are limited in their use. Many prior art inflatable tools, for example, are not capable of being used to abrade or polish relatively small internal surfaces in a workpiece. The complex structure of many prior art inflatable tools does not permit the tools to be easily manufactured in a variety of sizes.

Another problem with prior art inflatable tools is that the inflatable abrading surface and the surface being abraded are often easily damaged. Prior art inflatable tools typically have a rigid surface beneath the inflatable abrading surface that causes damage to the inflatable abrading surface and the workpiece when the inflatable abrading surface is forced against the workpiece. A further deficiency of the prior art is the limited shapes of the flexible abrading surface. The prior art inflatable tools provide only a substantially cylindrical abrading surface that has limited abrading applications.

The inflatable tool 10 shown in FIG. 1 and disclosed in U.S. Pat. No. 5,672,096, incorporated herein by reference, has solved the above problems. The inflatable tool 10 may be used for machining or preparing a workpiece surface 2 including, but not limited to, grinding, honing, deburring, sanding, buffing, polishing, finishing, and chamfering. The inflatable tool 10 can be used with any type of machining or other process for preparing a workpiece surface including external surfaces, internal surfaces, flat surfaces, and irregular surfaces.

The inflatable tool 10 is rotatably driven about its longitudinal axis by a machine tool (not shown) such as a drill, air driven rotator, CNC machine or the like. For example, a shank 12 of the inflatable tool 10 is secured in a chuck or other similar tool holder of the machine tool. The inflatable tool 10 can be rotatably driven, for example, with a drill press, lathe, milling machine, hand-drill, air tool and any other rotatably driven machine tool. According to one example, the inflatable tool can be rotated up to 5000 RPM.

The inflatable tool 10 includes an inflatable tool surface 14, such as an abrasive surface, or any other type of workpiece altering surface used for grinding, deburring, honing, sanding, polishing, buffing, chamfering, finishing or otherwise preparing a workpiece surface. The inflatable tool 10 also includes a core 16 that supports the inflatable tool surface 14 and about which the inflatable tool surface 14 expands. The shank 12 is preferably coupled to a first core end 15 of the core 16. In one embodiment, a valve 18 is operatively coupled proximate a second core end 17 of the core 16, as will be described in greater detail below.

The inflatable tool 10, FIG. 2, includes a core 16 comprising an inner core portion 20 and an elastomeric outer core portion 22 disposed around the inner core portion 20. The inner core portion 20 is preferably made of a steel, such as cold roll-12L14-1018, or any other metal or suitable rigid materials.

The inflatable tool 10 further includes an inflatable member or bladder 30 sealably fixed or clamped to the first core end 15 and the second core end 17. In an inflated state, a chamber or pocket 32 containing a pressurized medium, such as air, water, gel, or the like, exists between the inflatable bladder 30 and the elastomeric outer core portion 22 of core 16. The inflatable bladder 30 disposed around the elastomeric outer core portion 22 is preferably made of a non-molded rubber material that allows the inflatable bladder 30 to be easily inflated.

The inflatable tool surface 14 is preferably provided by an abrasive sleeve 34 disposed around the inflatable bladder 30 and held in place by the inflatable bladder 30 when inflated. Abrasive sleeves 34, as used herein include, but are not limited to, any sleeve or belt used for sanding, grinding, buffing, polishing, honing, finishing, or any type of workpiece surface preparation. When the inflatable abrasive surface 14 contacts a workpiece surface (not shown), the pocket or chamber 32 allows the inflatable tool surface 14 to yield or deform to conform to the workpiece surface.

The elastomeric outer core portion 22 of core 16 provides a resilient surface 36 behind the inflatable tool surface 14. In a deflated state, the inflatable bladder 30 preferably lies against the resilient surface 36 of the elastomeric outer core portion 22. If the inflatable tool surface 14 is forced against a workpiece, for example, the resilient surface 36 on the elastomeric outer core portion 22 will provide a cushion and prevent damage to the workpiece, the inflatable bladder 30, and the inflatable tool surface 14, such as abrasive sleeve 34. The elastomeric outer core portion 22 is preferably made out of rubber, such as a vulcanized rubber of about 40 to 45 Durometer, or any other suitable elastomeric material.

A passageway 38 preferably extends through the inner core portion 20 and elastomeric outer core portion 22 so that the pressurized medium, such as air, can be provided to the pocket or chamber 32 to inflate the inflatable bladder 30. The valve 18 is coupled to an inflating device 40 that provides the pressurized medium through a valve passageway 42 in the valve 18. The valve passageway 42 is in fluid communication with the passageway 38 through the inner core portion 20 and elastomeric outer core portion 22. The valve 18 includes a coupling region 44 that operatively couples the valve 18 to the inflating device 40, for example, by threading the inflating device 40 into the valve coupling region 44.

The width and amount of cushion provided by the pocket or chamber 32 can be adjusted by varying the amount of pressurized medium, for example, within the range of about 0.02 to 0.4 inches wide. Varying the inflation thereby adjusts the diameter of the inflatable tool 10 and allows the abrasive sleeve 34 to be removed and replaced. The inflation and width of the chamber 32 can be varied to any degree depending upon the size of the inflatable tool and the desired application for the tool.

The inflatable tool 10 includes a first end clamping plate 50 that sealably clamps a first end 31 of the inflatable bladder 30 to the first core end 15, and a second end clamping plate 52 that sealably clamps a second end 33 of the inflatable bladder 30 to the second core end 17. A first engaging member 54 secures the first end clamping plate 50 to the first core end 15. In one example, the first engaging member 54 is disposed at one end of the shank 12 and is threadably engaged within the inner core portion 20. A second engaging member 56 secures the second end clamping plate 52 against the second core end 17, for example, by threadably engaging with the valve 18 which is threadably engaged within the inner core portion 20.

In one embodiment, the inflatable tool 10, FIG. 3, includes one or more bulging abrasive or workpiece finishing regions 60. According to this embodiment, the inflatable bladder 30 is preferably made from a non-molded rubber material such as tire inner tube material that facilitates the bulging. The bulging abrasive region 60 is preferably created by providing one or more slots 62 in an abrasive sleeve 64. The slots 62 allow the inflatable bladder 30 to expand to a greater diameter, thereby creating the bulging abrasive region 60.

The abrasive sleeve 64, FIG. 4, includes a sleeve portion 66 having one or more series of slots 62*a*, 62*b* extending substantially longitudinally in the sleeve portion 66 and circumferentially spaced around the sleeve portion 66. The slots 62*a*, 62*b* are preferably parallel and evenly distributed around the circumference of the sleeve portion 66. Each series of slots 62*a*, 62*b* are also spaced longitudinally along the sleeve portion 66 to form first and second bulging abrasive regions 60*a*, 60*b*, when the inflatable tool 10 is inflated.

One example of the abrasive sleeve 64 is sand paper having a sleeve portion 66 made of "Scotchbrite" material. The abrasive sleeve 64 can have various types of sleeve portions 66 with various types of surfaces used in grinding, honing, deburring, polishing, buffing, sanding, finishing, and other types of surface preparation.

Although the abrasive sleeve 64 having the slots 62 has provided a number of advantages, this abrasive sleeve 64 has some limitations in that the sleeve portion 66 is made of a non-stretchable material. The degree to which the abrasive sleeve 64 can bulge is thus limited by the inability of the sleeve portion 66 to expand. The bulging abrasive sleeve 64 reaches a point where any additional pressure will cause the sleeve portion 66 to rip. The abrasive sleeve 64 also does not work as well on larger diameters. The abrasive sleeve 64 (FIG. 3) does not expand all the way to the end, leaving unexpanded regions 65 and limiting the abrasive contact with the workpiece. Also, the strips of abrasive formed by the slots 62 may get caught on surface irregularities, causing damage to the abrasive sleeve 64.

Accordingly, what is needed is an expandable abrasive sleeve capable of expanding to a wider range of diameters without tearing and without getting caught on surface irregularities. A need also exists for an expandable abrasive sleeve that is capable of expanding more uniformly and generally to the ends of the abrasive sleeve to improve the abrasive contact with the workpiece and to conform better to larger diameters.

SUMMARY OF THE INVENTION

The present invention features an expandable abrasive sleeve for use on an inflatable tool to abrade or condition a surface of a workpiece. The expandable abrasive sleeve comprises an elastomeric backing, for example, made of a rubber material, and a plurality of separate abrasive strips adhered to the elastomeric backing in an overlapping relationship such that the strips overlap when the sleeve is expanded. Each of the separate abrasive strips includes an abrasive material on a strip of non-stretchable backing material, and a portion of the non-stretchable backing material is adhered to the elastomeric backing.

The present invention also features an expandable abrasive sleeve comprising an elastomeric backing with a plurality of stiffeners embedded therein and an abrasive material adhered to the elastomeric backing such that the elastomeric backing is capable of expanding when the inflatable tool is inflated.

The present invention also features an expandable abrasive tool with an expandable abrasive sleeve. The tool comprises a core having a first core end and a second core end and having at least one passageway extending through a central region of the core. A rubber bladder is disposed over the core and sealably fixed to the core at the first core end and the second core end.

The rubber bladder forms a chamber between the rubber bladder and the core in an inflated state when a pressurized medium passes through the passageway. An expandable abrasive sleeve is disposed around the rubber bladder and expands from at least proximate a first end of the sleeve to at least proximate a second end of the sleeve. A stiffener sleeve having stiffeners embedded in an elastomeric material can be used between the abrasive sleeve and bladder.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 5:
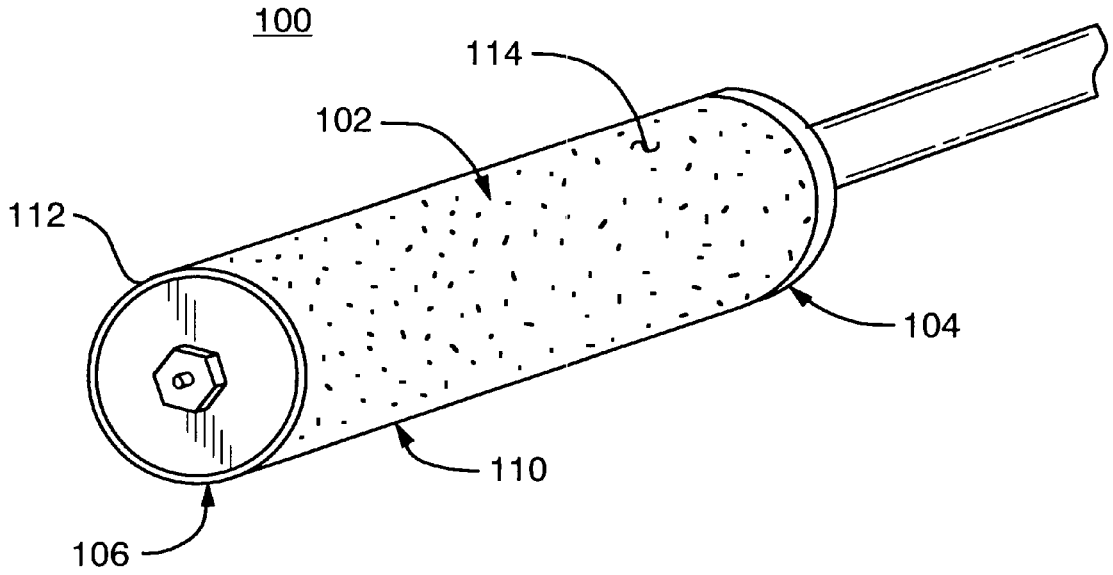
FIGS. 5 and 6 are perspective views of a deflated and expanded expandable abrasive sleeve, respectively, according to one embodiment of the present invention.
Figure 6:
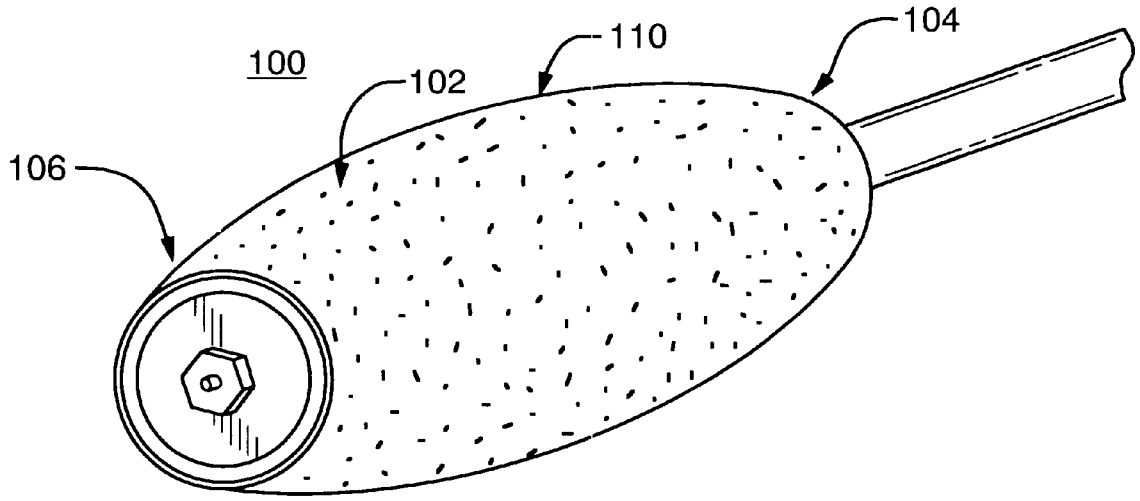

The inflatable tool 100, FIGS. 5 and 6, according to the present invention, includes an expandable abrasive region 102. The abrasive region 102 is preferably formed by an expandable abrasive belt or sleeve 110 having an elastomeric backing 112 and an abrasive material 114 adhered to the elastomeric backing 112. The elastomeric backing 112 allows the expandable abrasive sleeve 110 to expand from proximate the first end 104 to proximate the second end 106 of the expandable abrasive sleeve 110. Various embodiments of the expandable abrasive sleeve 110 are described below.

Figure 7:
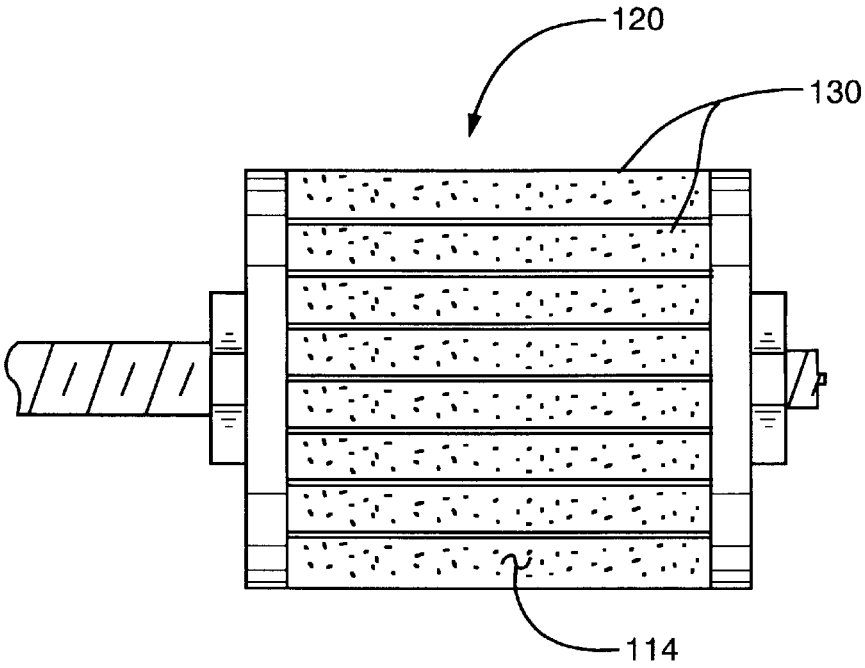
FIGS. 7 and 8 are side views of a deflated and expanded expandable abrasive sleeve, respectively, having abrasive strips, according to another embodiment of the present invention.
Figure 8:
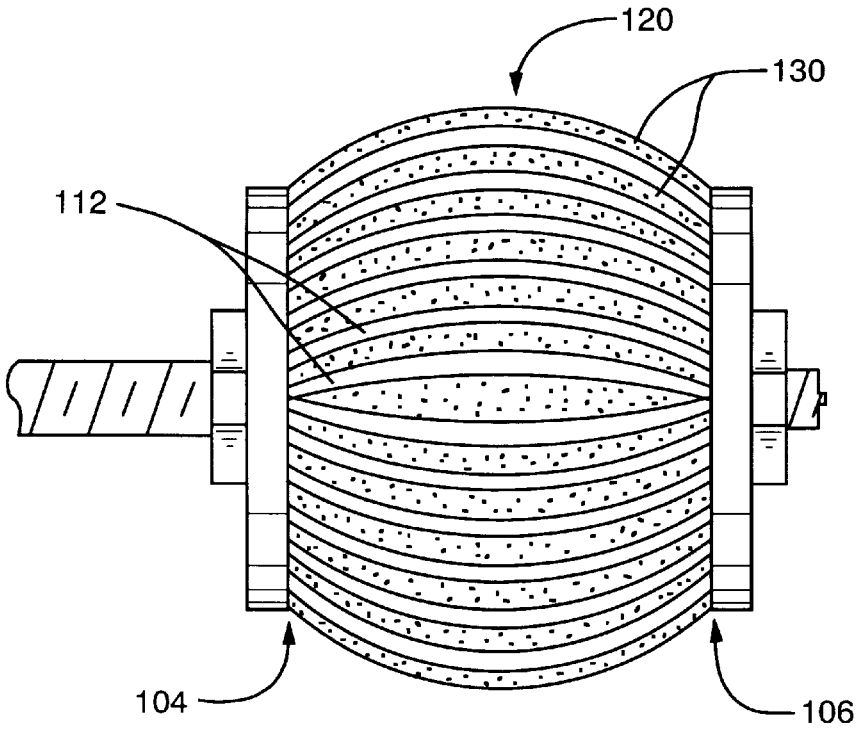
Figure 9:
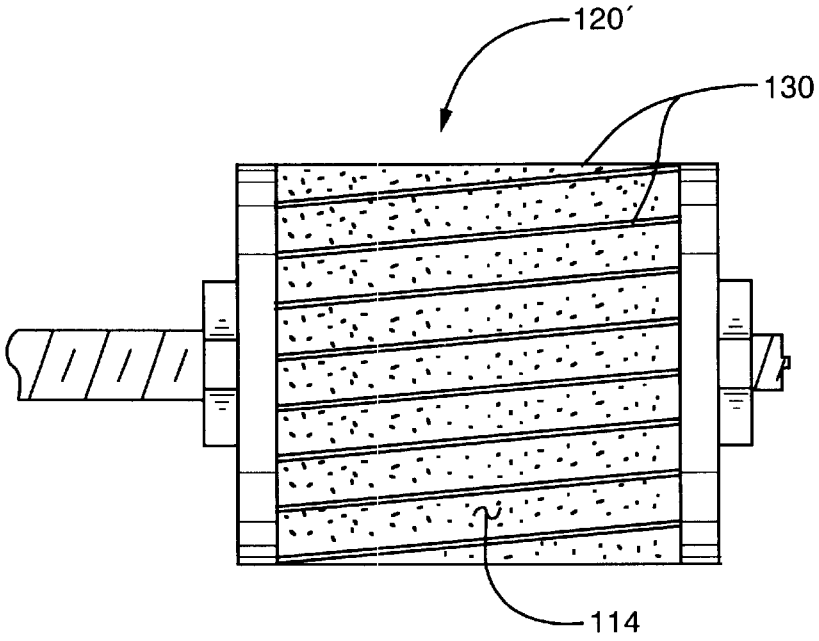
FIGS. 9 and 10 are side views of a deflated and expanded expandable abrasive sleeve, respectively, having abrasive strips in a spiral configuration, according to a further embodiment of the present invention.
Figure 10:
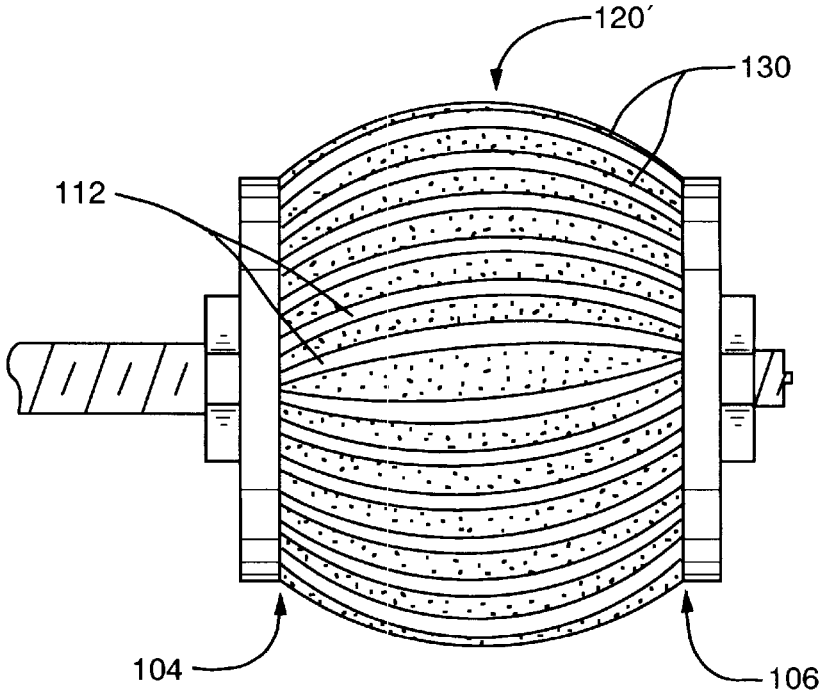

According to one embodiment, an expandable abrasive sleeve 120, FIGS. 7 and 8, includes the abrasive material 114 on abrasive strips 130 adhered to the elastomeric backing 112. In this embodiment, the expandable abrasive sleeve 120 has abrasive strips 130 extending generally longitudinally along the expandable abrasive sleeve 120. In a further embodiment, an expandable abrasive sleeve 120', FIGS. 9 and 10, has abrasive strips 130 extending at an angle to form a spiral configuration around the elastomeric backing 112. When the expandable abrasive belt 110 expands (FIGS. 8 and 10), the elastomeric backing 112 expands between the abrasive strips 130 to allow the expandable abrasive sleeve 120, 120' to expand generally from the first end 104 to the second end 106. Providing the abrasive strips 130 at an angle on the abrasive sleeve 120' prevents the abrasive strips 130 from "catching" on surface irregularities and reduces the likelihood of damage to the abrasive sleeve 120'. The angled configuration in this embodiment also enables the elastomeric backing 112 to stretch more consistently.

Figure 11:
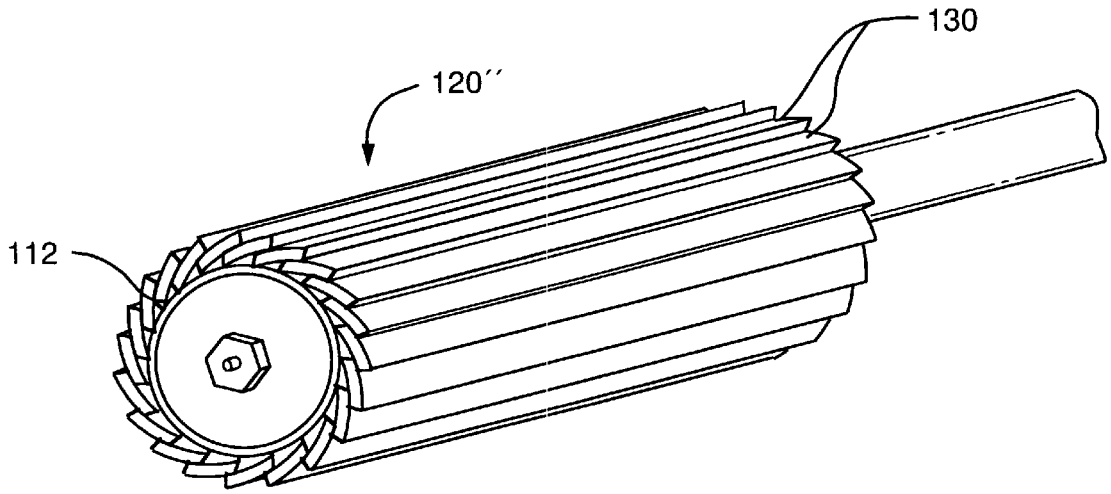
FIGS. 11 and 12 are perspective views of a deflated and expanded abrasive sleeve, respectively, having overlapping abrasive strips, according to a further embodiment of the present invention.
Figure 12:
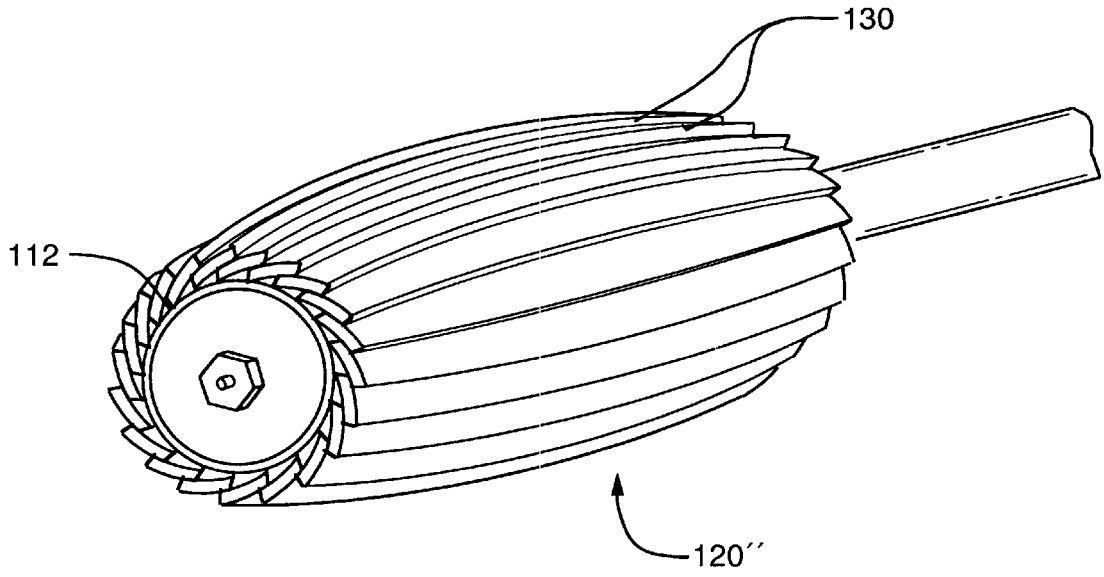

According to the preferred embodiment of the abrasive sleeve 120", FIGS. 11 and 12, the abrasive strips 130 are overlapping. The overlap should be sufficient to maintain the overlapping relationship when the abrasive sleeve 120" is expanded. In the exemplary embodiment, approximately about ½ of the width of each abrasive strip 130 is adhered to the elastomeric backing 112 with the remaining width of each abrasive strip 130 overlapping an adjacent strip. The overlapping relationship in this embodiment prevents the abrasive strips 130 from "catching" on surface irregularities. One particular application in which this is useful is in an internal cylindrical surface having a cut-out or slot in a side of the cylindrical surface. The overlap of the strips 130 prevents the strips from catching on the edge of the cut-out. The overlapping strips 130 can extend generally longitudinally as shown in FIGS. 11 and 12 or can extend at an angle similar to the embodiment shown in FIGS. 9 and 10.

In these embodiments, the abrasive strips 130 can be formed from conventional abrasive sheets, such as sandpaper, having a non-stretchable backing material, such as paper or cloth. Alternatively, the backing material of the abrasive strips 130 can be rigid or semi-rigid. Any type of abrasive material 114 can be used including, but not limited to, aluminum oxide, diamonds, silicone carbide, ceramic, zirconia, CBN, carbide chips, or any other material capable of cutting or abrading. Alternatively, the abrasive material 114 can also include a material, such as a felt, used for polishing, buffing, finishing or otherwise preparing a workpiece surface. According to one method, the abrasive strips 130 are formed by cutting the abrasive sheet into strips. In one example, each of the strips 130 has a length in the range of about 1 to 3 in. and width in the range of about ⅛ to 1 in. The strips 130 can be made in virtually any size depending upon the application and the size of the sleeves. The abrasive strips 130 are then adhered to the elastomeric backing 112, as described in greater detail below.

Figure 13:
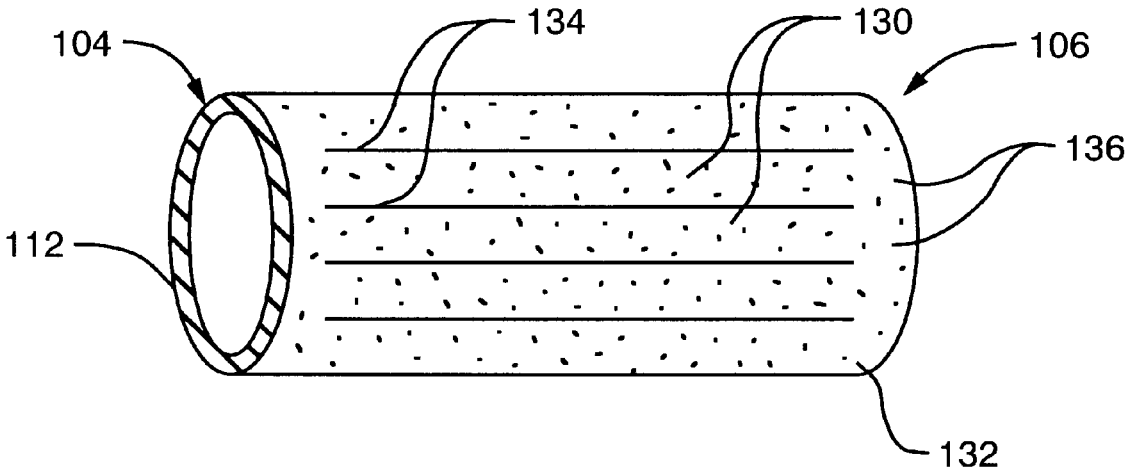
FIG. 13 is a side, cross-sectional view of an abrasive sheet having slots forming the abrasive strips, according to a further embodiment of the present invention.

According to another method, a sheet of abrasive material 132, FIG. 13, is formed with slots 134 to form the abrasive strips 130 integral with the sheet 132. Initially, the abrasive strips 130 in this embodiment are not separated but are connected at the ends 136. The slotted abrasive sheet 132 is then adhered to the elastomeric backing 112, as will be described in greater detail below. Initially keeping the abrasive strips 130 attached at the ends 136 facilitates the positioning of the abrasive strips 130 on the rubber material of the elastomeric backing 112. During expansion, the abrasive strips 130 may separate at the ends 136 or may stay connected depending upon the degree of expansion. Thus, the expandable abrasive sleeve may expand only to points proximate the first end 104 and the second end 106 and not completely to the ends 104, 106. This expandable abrasive sheet is capable of expanding all the way to the ends 104, 106 if the sheet 132 tears along the slots 134 at the ends 136 during expansion. Since the slotted abrasive sheet 132 is adhered to the elastomeric backing material 112, the abrasive strips 130 will remain intact even if such tearing occurs.

The abrasive strips can be adhered to the elastomeric backing using any conventional method. According to one method of adhering the abrasive strips 130 (FIGS. 7–12) or the sheet 132 (FIG. 13), the strips 130 or sheet 132 are placed onto an uncured rubber material used for the elastomeric backing 112 and held in position, for example, by wrapping in mylar. The rubber material can be selected according to the desired properties, as is well known to those of ordinary skill in the art. One example of the uncured rubber material is a natural rubber with an SBR blend (e.g. about 1.5% SBR). Other types of elastomeric materials include, but are not limited to, an NEPDM polymer, an oil resistant synthetic rubber such as neoprene, and an oil and heat resistant elastomer such as VITON®. Other elastomeric materials can also be used depending upon the application or use of the abrasive sleeve.

The uncured rubber material is then placed in an oven for curing, and when the rubber cures, the abrasive strips 130 or sheet 132 adheres to the rubber material of the elastomeric backing 112. The curing temperature is typically between about 250° F. to 305° F. and depends upon the type of rubber used for the elastomeric backing 112. Natural rubber with SBR blend, for example, is heated at about for about 1 hour at about 280° F. and NEPDM polymer is heated at about 300° F. for about 1 hour. A bonding agent, such as CHEMLOC 250, is preferably applied to the strips 130 or sheet 132 to facilitate bonding with the rubber during vulcanization. Other methods known to those of ordinary skill in the art can also be used for adhering the abrasive strips to rubber.

Figure 1:
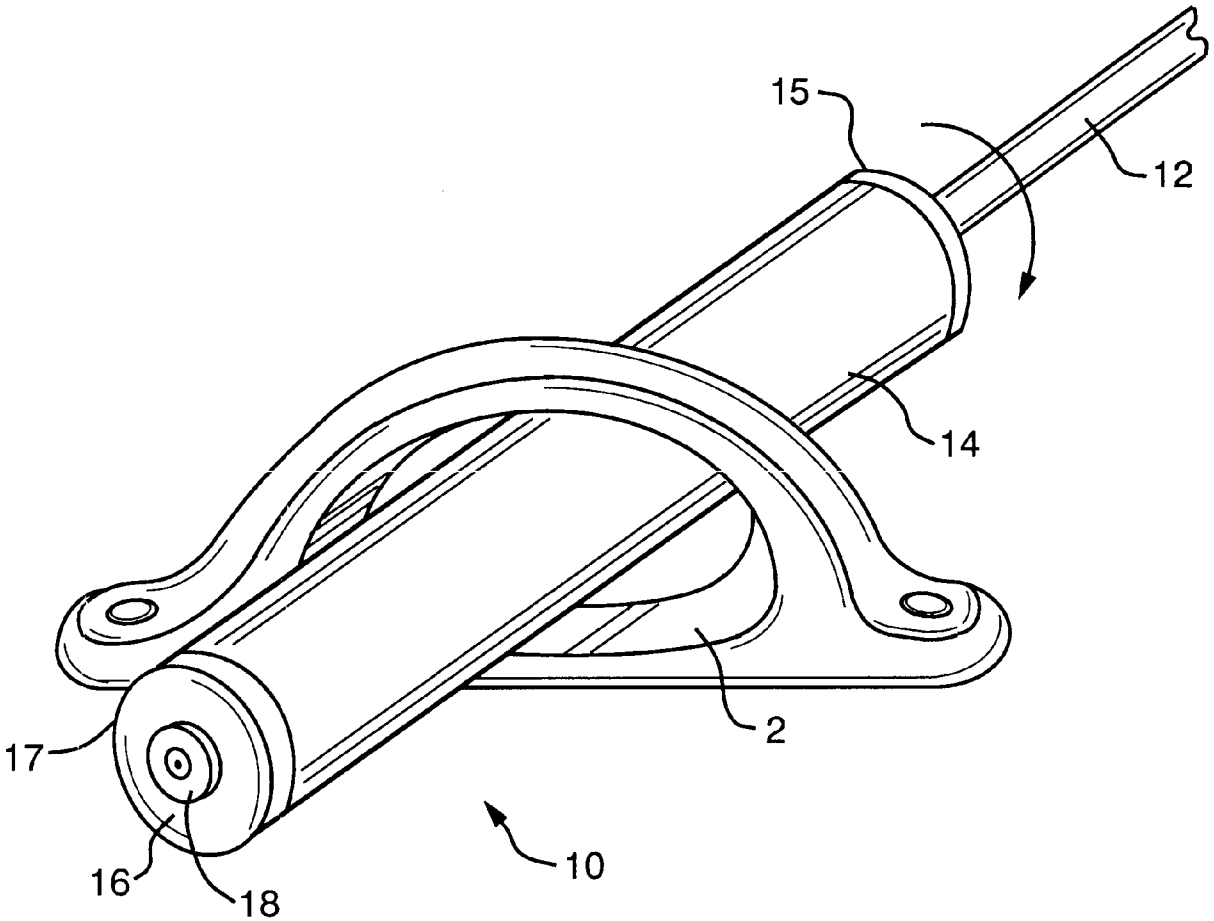
FIG. 1 (PRIOR ART)
FIG. 1 is a perspective view of an inflatable tool, according to the prior art, being used to abrade an internal surface of a workpiece.
Figure 2:
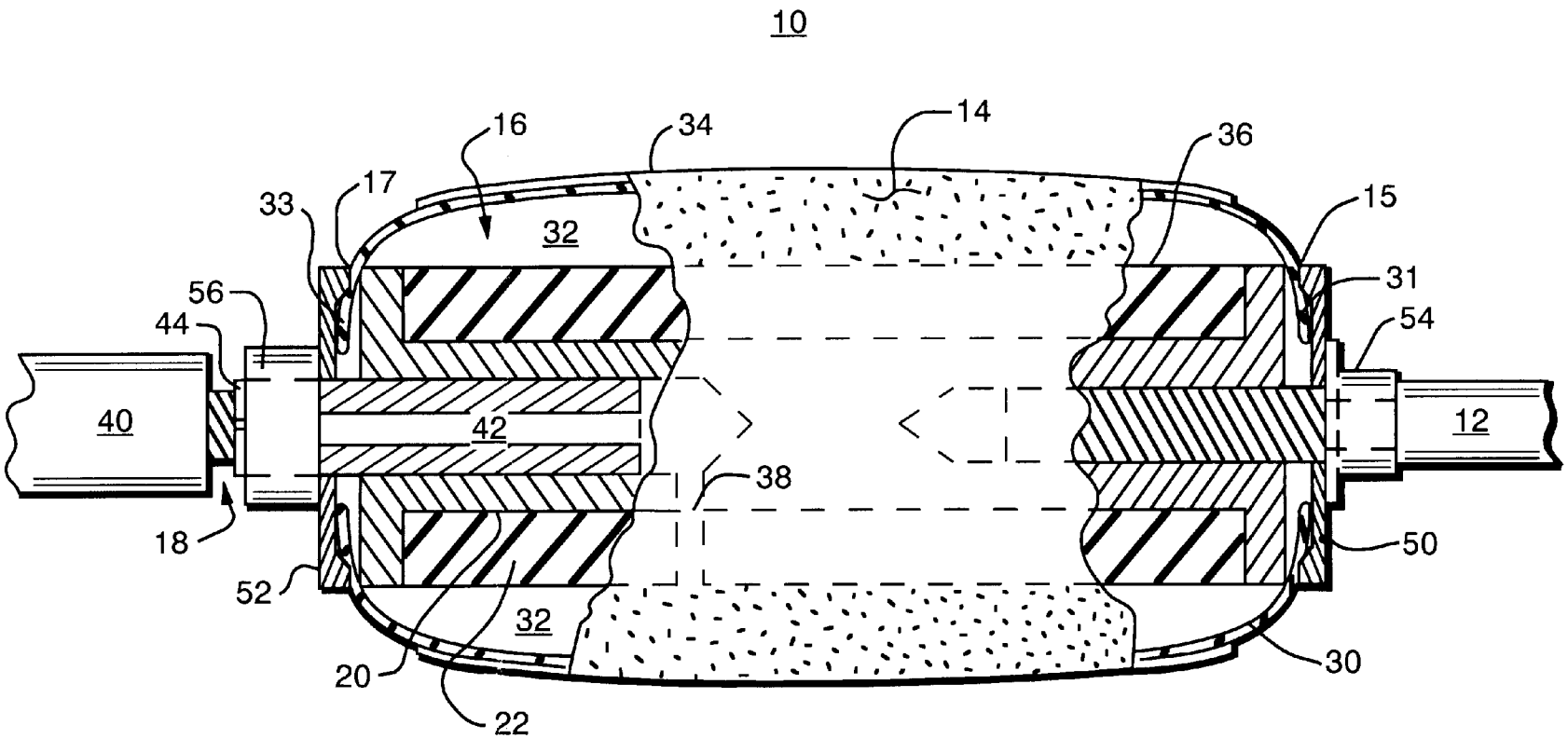
FIG. 2 (PRIOR ART)
FIG. 2 is a partial cross-sectional view of the inflatable tool according to the prior art.
Figure 3:
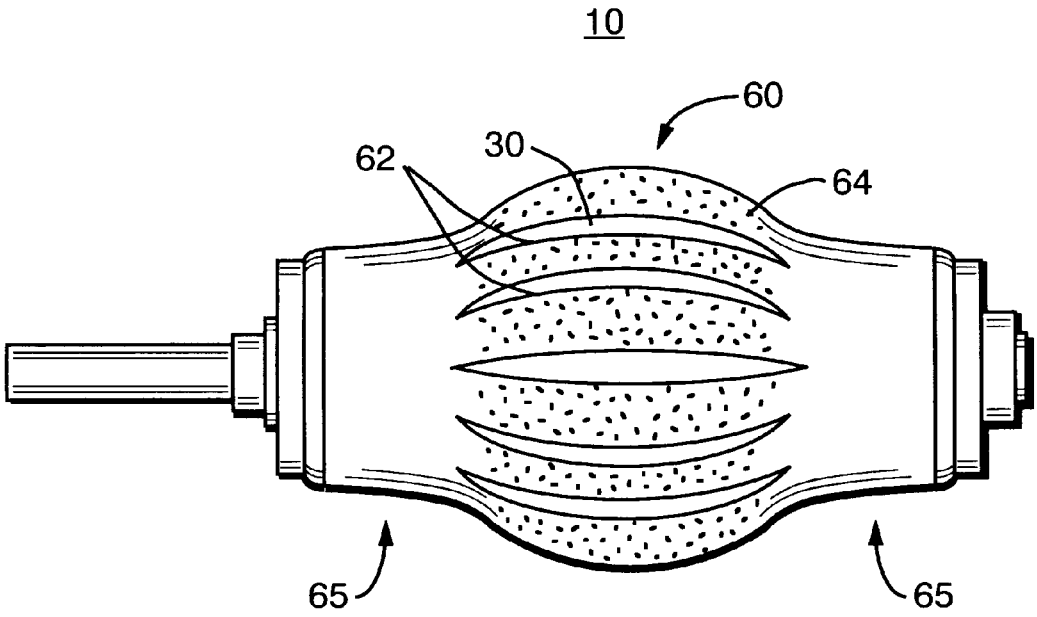
FIG. 3 (PRIOR ART)
FIG. 3 is a side view of the inflatable tool having a bulging abrasive region according to the prior art.
Figure 4:
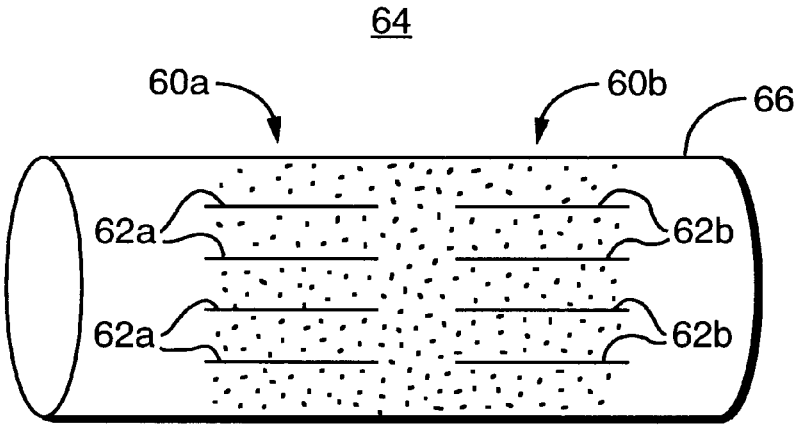
FIG. 4 (PRIOR ART)
FIG. 4 is a side view of an abrasive sleeve according to the prior art.

According to a further embodiment, the expanding abrasive sleeve 110 (FIGS. 5 and 6) includes the abrasive material 114 adhered directly to the elastomeric backing 112. In another embodiment, the abrasive could be applied directly to the rubber bladder 30 of the inflatable tool 10 (see FIG. 2). One method of making the embodiment with abrasive 114 directly on the elastomeric backing 112 is by wrapping sandpaper around the uncured rubber of the backing 112 with the grit facing the uncured rubber. The rubber is then vulcanized by heating, as described above. When the sandpaper backing is removed, the grit remains adhered to and embedded in the vulcanized rubber.

The elastomeric backing 112 can also be made of other suitable elastomeric or stretchable materials, and the abrasive material 114 can also be applied to the elastomeric backing 112 using other methods.

Figure 14:
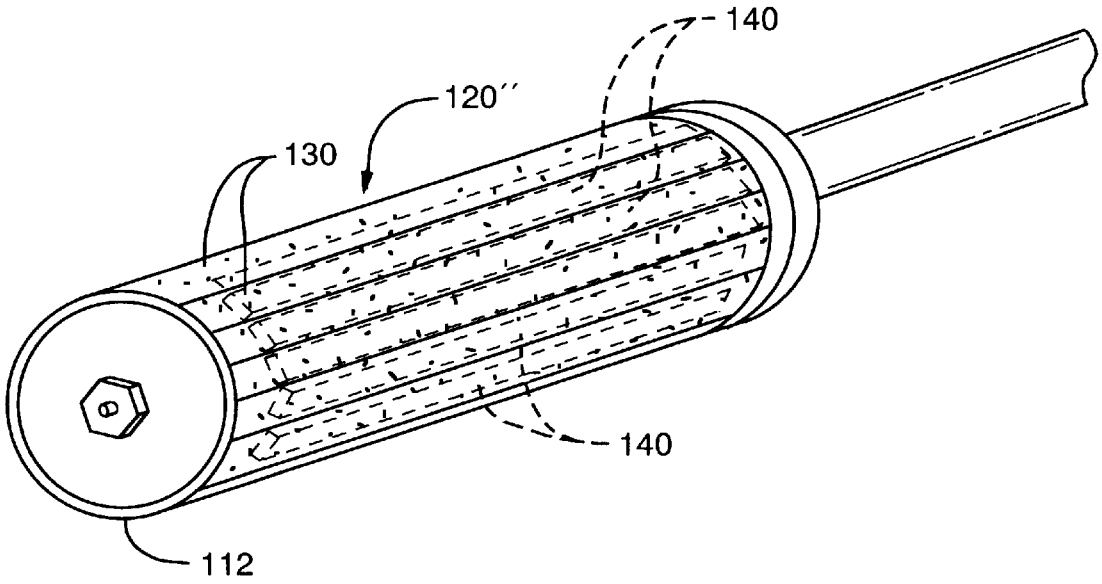
FIGS. 14 and 15 are perspective views of a deflated and expanded expandable abrasive sleeve, respectively, having abrasive strips with stiffeners, according to yet another embodiment of the present invention.
Figure 15:
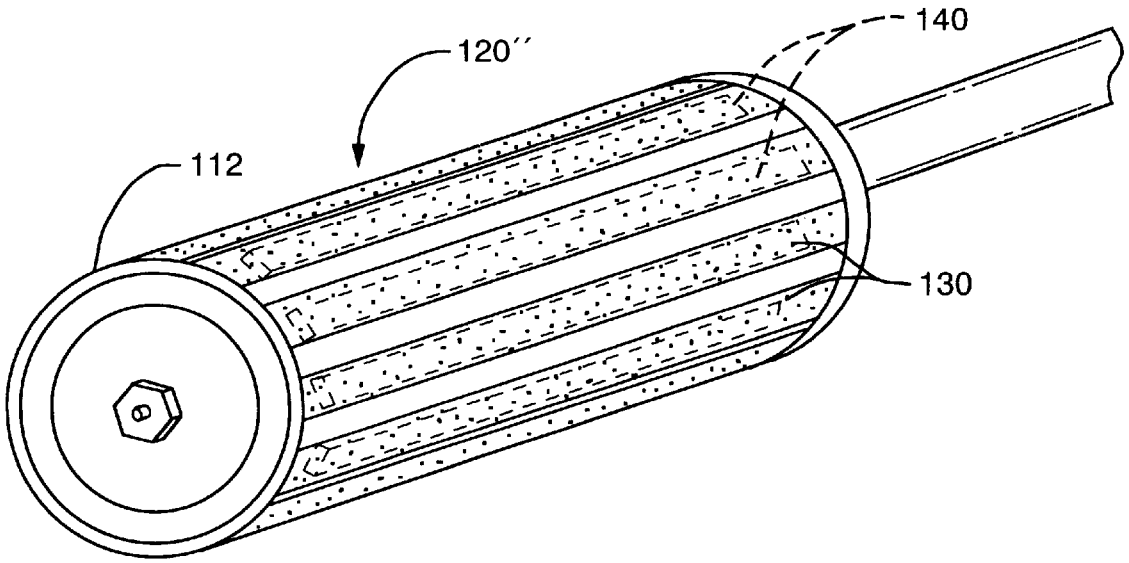

According to a further embodiment, the elastomeric backing 112, FIGS. 14 and 15, includes stiffeners 140 to create a generally constant OD dimension when the abrasive sleeve expands. In one example, the stiffeners 140 are steel bars embedded within the elastomeric backing 112, extending generally longitudinally, and spaced from one another to allow expansion of the abrasive sleeve. According to one method, the stiffeners 140 are positioned between two plies of uncured rubber and are embedded by vulcanizing the rubber. A bonding agent, such as CHEM-LOC 250, is preferably applied to the stiffeners 140 to facilitate bonding with the rubber during vulcanization. The stiffeners 140 can be used in any one of the embodiments of the abrasive sleeve 110, 120, 120', 120" disclosed above. In the embodiment with abrasive strips 130, the stiffeners 140 may or may not be positioned under each of the abrasive strips 130. Alternatively, a stiffener sleeve having a rubber belt with stiffeners embedded therein (but no abrasive) can be used separately between an abrasive sleeve and the inflatable tool.

Expanding with the stiffeners provides a better tolerance for internal abrading. In one application, the expandable abrasive sleeve with stiffeners can be used to flatten high spots in an internal bore. In another application, the expandable abrasive sleeve with stiffeners can be used to finish to the bottom of a blind hole.

The expandable abrasive sleeves 110, 120, 120', 120" of the present invention can be used with the inflatable tool 10 described above and in U.S. Pat. No. 5,672,096,. as well as with any other inflatable tool. The expandable abrasive tool can be used according to the method described in U.S. Pat. No. 5,672,096 or any other method of abrading or otherwise treating a workpiece surface. One application for the expandable abrasive tool 100 having the expandable abrasive sleeve 110 includes abrading or finishing an ID or any type of internal surface as well as peripheries or any type of external surface of a workpiece or part.

Accordingly, the present invention provides an expandable abrasive tool and an expandable abrasive sleeve that is capable of expanding to a greater range of diameters without causing damage to the abrasive sleeve. In at least one embodiment, the expandable abrasive sleeve is also capable of expanding uniformly generally from one end to the other end, as opposed to merely bulging at one or more regions, and thus conforms better to a workpiece, especially a workpiece having a larger diameter. The expandable abrasive sleeve thereby provides more abrasive contact and better material removal during abrading.

Modifications and substitutions by one of ordinary skill in the art are considered to be within the scope of the present invention which is not to be limited except by the claims which follow.

What is claimed is:

1. An expandable abrasive sleeve, for use on an inflatable tool to abrade a surface of a workpiece, said expandable abrasive sleeve comprising:

an elastomeric backing, for positioning on the inflatable tool; and a plurality of separate abrasive strips adhered to said elastomeric backing in an overlapping relationship, wherein each of said abrasive strips overlaps an adjacent one of said abrasive strips when said expandable abrasive sleeve is expanded.

2. The expandable abrasive sleeve of claim 1 wherein said plurality of abrasive strips extend generally longitudinally on said elastomeric backing.

3. The expandable abrasive sleeve of claim 1 further including a plurality of stiffeners embedded within said elastomeric backing.

4. The expandable abrasive sleeve of claim 1 wherein said abrasive strips include said abrasive material adhered to a non-stretchable backing material, and wherein a portion of said non-stretchable backing material is adhered to said elastomeric backing.

5. The expandable abrasive sleeve of claim 1 wherein said elastomeric backing is a rubber material.

6. An expandable abrasive sleeve, for use on an inflatable tool to abrade a surface of a workpiece, said expandable abrasive sleeve comprising:

an elastomeric backing, for positioning on the inflatable tool;

a plurality of stiffeners embedded within said elastomeric backing; and an abrasive material adhered to said elastomeric backing such that said elastomeric backing is capable of expanding when the inflatable tool is inflated.

7. The expandable abrasive sleeve of claim 6 wherein said stiffeners include steel bars extending generally longitudinally within said elastomeric backing.

8. The expandable abrasive sleeve of claim 6 wherein said elastomeric backing is a rubber material.

9. The expandable abrasive sleeve of claim 6 wherein said abrasive material is disposed on a plurality of abrasive strips adhered to said elastomeric backing in an overlapping relationship, wherein each of said abrasive strips overlaps an adjacent one of said abrasive strips when said expandable abrasive sleeve is expanded.

10. The expandable abrasive sleeve of claim 9 wherein said plurality of abrasive strips extend generally longitudinally on said elastomeric backing.

11. The expandable abrasive sleeve of claim 9 wherein said abrasive strips include said abrasive material adhered to a non-stretchable backing material, and wherein a portion of said non-stretchable backing material is adhered to said elastomeric backing.

12. An expandable abrasive tool, comprising:

a core having a first core end and a second core end and having at least one passageway extending through a central region of said core;

a rubber bladder disposed over said core and sealably fixed to said core at said first core end and said second core end, and said rubber bladder forming a chamber between said rubber bladder and said core in an inflated state when a pressurized medium passes through said at least one passageway; and an expandable abrasive sleeve disposed around said rubber bladder, said expandable abrasive sleeve including an elastomeric backing and an abrasive material adhered to said elastomeric backing, and wherein said expandable abrasive sleeve expands from at least proximate a first end of the expandable abrasive sleeve to at least proximate a second end of the expandable abrasive sleeve.

13. The expandable abrasive tool of claim 12 wherein said abrasive material is disposed on a plurality of abrasive strips adhered to said elastomeric backing in an overlapping relationship, wherein each of said abrasive strips overlaps an adjacent one of said abrasive strips when said expandable abrasive sleeve is expanded.

14. The expandable abrasive tool of claim 12 further including a plurality of stiffeners embedded within said elastomeric backing.

15. The expandable abrasive tool of claim 12 further including a stiffener sleeve disposed between said expandable abrasive sleeve and said bladder.

16. The expandable abrasive tool of claim 15 wherein said stiffener sleeve includes an elastomeric material having stiffeners embedded therein.

* * * * *